US009687869B2

(12) United States Patent
Kim et al.

(10) Patent No.: US 9,687,869 B2
(45) Date of Patent: Jun. 27, 2017

(54) PIPE-SHAPE STRUCTURE COATING DEVICE AND METHOD

(71) Applicant: SAMSUNG HEAVY IND. CO., LTD, Seoul (KR)

(72) Inventors: Sangwhee Kim, Gyeonggi-do (KR); Eunjung Kim, Daejeon (KR); Young-il Shin, Daejeon (KR); Seong Ho Cho, Daejeon (KR); Jinhyung Park, Daejeon (KR)

(73) Assignee: SAMSUNG HEAVY IND. CO., LTD, Seoul (KR)

( * ) Notice: Subject to any disclaimer, the term of this patent is extended or adjusted under 35 U.S.C. 154(b) by 426 days.

(21) Appl. No.: 14/350,480

(22) PCT Filed: Oct. 19, 2012

(86) PCT No.: PCT/KR2012/008585
§ 371 (c)(1),
(2) Date: Apr. 8, 2014

(87) PCT Pub. No.: WO2013/058592
PCT Pub. Date: Apr. 25, 2013

(65) Prior Publication Data

US 2014/0251206 A1 Sep. 11, 2014

(30) Foreign Application Priority Data

Oct. 20, 2011 (KR) ..... 10-2011-0107489

(51) Int. Cl.
*B05B 13/06* (2006.01)
*B05B 13/04* (2006.01)
(Continued)

(52) U.S. Cl.
CPC ..... *B05B 13/0636* (2013.01); *B05B 3/02* (2013.01); *B05B 13/005* (2013.01);
(Continued)

(58) Field of Classification Search
CPC . B05B 13/005; B05B 13/0636; B05B 13/041; B05B 13/0421; B05B 3/02; B05B 15/064; B05B 15/068; B05B 15/08
See application file for complete search history.

(56) References Cited

U.S. PATENT DOCUMENTS 4,181,092 A * 1/1980 Johnson ..... B24C 3/325 118/306
2001/0003989 A1* 6/2001 MacNeil ..... B08B 9/0433 134/167 C

FOREIGN PATENT DOCUMENTS

DE 3301548 A1 7/1984
JP H01168370 A 7/1989
(Continued)

OTHER PUBLICATIONS

International Search Report issued in corresponding application No. PCT/KR2012/008585 mailed Feb. 20, 2013.

*Primary Examiner* — Dah-Wei D Yuan
*Assistant Examiner* — Stephen Kitt
(74) *Attorney, Agent, or Firm* — Carter, DeLuca, Farrell & Schmidt, LLP

(57) ABSTRACT

Disclosed is a pipe-shape structure coating device. A pipe-shape structure coating device according to one embodiment of the present invention includes: a rack unit on which a pipe-shape structure is placed, and a work vehicle which carries out a coating process on an inner surface of the pipe-shape structure by driving inside the pipe-shape structure placed on the rack unit along a longitudinal direction of the pipe-shape structure.

7 Claims, 7 Drawing Sheets

(51) Int. Cl.

| | |
|---|---|
| ***B05B 3/02*** | (2006.01) |
| ***B05B 15/08*** | (2006.01) |
| ***B05B 13/00*** | (2006.01) |
| *B05B 15/06* | (2006.01) |

(52) U.S. Cl.
CPC ..... *B05B 15/068* (2013.01); *B05B 15/08* (2013.01); *B05B 13/041* (2013.01); *B05B 13/0421* (2013.01); *B05B 15/064* (2013.01)

(56) References Cited

FOREIGN PATENT DOCUMENTS

| | | | |
|---|---|---|---|
| JP | 05-068917 | A | 3/1993 |
| JP | H06117197 | A | 4/1994 |
| JP | 07-171531 | A | 7/1995 |
| JP | 2000-145391 | A | 5/2000 |
| KR | 1020050054121 | A | 6/2005 |
| KR | 10-0848177 | A | 1/2008 |
| KR | 100818185 | B1 | 3/2008 |
| KR | 10-2009-046586 | A | 5/2009 |
| KR | 10-2009-0053247 | A | 5/2009 |
| KR | 10-0917317 | B1 | 9/2009 |
| KR | 1020100064475 | A | 6/2010 |
| KR | 10-1059395 | B1 | 8/2011 |

* cited by examiner

PIPE-SHAPE STRUCTURE COATING DEVICE AND METHOD

CROSS-REFERENCE TO RELATED APPLICATIONS

The present application is a national stage application of International Application No. PCT/KR2012/008585 filed Oct. 19, 2012, which claims the benefit and priority of Korean Patent Application No. 10-2011-0107489, filed on Oct. 20, 2011, the entire contents of each of which are hereby incorporated by reference in their entirety.

TECHNICAL FIELD

The present inventive concept herein relates to a coating device, and more particularly, to a device and method for automatically applying a pipe-shape structure such as a tower of a wind power generator.

BACKGROUND ART

A wind power generator has a tower in which a plurality of sections are connected to each other. Each of the sections of the tower has a conical shape having a length of about 20 m and an outer diameter of about 3 m to about 4 m. Grit blasting and grit collecting, and spray coating are performed on inner and outer sections of the tower of the wind power generator to provide corrosion resistant.

In manufacturing of the tower of the existing wind power generator, the coating process with respect to the inside of the tower has depended on the handworks of workers. Therefore, there are limitations in that the coating process manually performed by the workers is inefficient, the working environments are harmful, and the coating quality is non-uniform.

DISCLOSURE OF THE INVENTION

Technical Problem

Embodiments of the present invention provide a pipe-shape structure coating device and method that are capable of automatically performing coating of a large-scale pipe-shape structure such as a tower of a wind power generator.

Embodiments of the present invention also provide a pipe-shape structure coating device and method in which a coating process is efficiently improved.

Embodiments of the present invention also provide a pipe-shape structure coating device and method that are capable of constantly maintaining a distance between a coating surface and a nozzle.

The object of the present invention is not limited to the aforesaid, but other objects not described herein will be clearly understood by those skilled in the art from descriptions below.

Technical Solution

Embodiments of the inventive concept provide a pipe-shape structure coating device includes: a work vehicle performing a coating process with respect to an inner circumferential surface of a pipe-shape structure while traveling along a longitudinal direction in the pipe-shape structure.

The work vehicle may include at least one rotation arm rotating along the circumferential direction of the pipe-shape structure; and a work tool disposed on the at least one rotation arm.

The work vehicle may further include: a movable vehicle traveling along the longitudinal direction in the pipe-shape structure; a column member vertically disposed on the movable vehicle; a body disposed on the column member, the body comprising a rotation shaft in parallel with the longitudinal direction of the pipe-shape structure; at least one rotation arm connected to the rotation shaft to rotate along the circumferential direction of the pipe-shape structure; and a work tool disposed on the at least one rotation arm.

The column member may be adjustable in length.

The pipe-shape structure coating devices may further include a suction nozzle disposed in the movable vehicle to collect grits lying on a bottom of the inner circumferential surface of the pipe-shape structure.

The work vehicle may further include a distance adjustable member varying a length of the rotation arm.

The rotation arm may include: a fixing arm connected to the rotation shaft; and a sliding arm extendably inserted into the fixing arm and on which the work tool is disposed, and the distance adjustable member slides the sliding arm with respect to the fixing arm.

The distance adjustable member may include: a first driving part disposed in the body; a slide block slidably disposed on the rotation shaft, the slide block being slid in a longitudinal direction of the rotation shaft by the first driving part; a rotation ring slid together with the slide block, the rotation ring being rotated together with the rotation shaft; and a link arm having one end hinge-coupled to the rotation ring and the other end hinge-coupled to the sliding arm.

The work tool may include at least one of a coating nozzle and a blasting nozzle, which spray paint.

The pipe-shape structure coating devices may further include a rack unit on which the pipe-shape structure is disposed.

The work vehicle may include: a body comprising first and second rotation shafts coaxially disposed in parallel with the longitudinal direction of the pipe-shape structure, a rotation driving part driving the first rotation shaft, and the first driving part driving the second rotation shaft; a fixing arm connected to the first rotation shaft, the fixing arm being limitlessly rotated along the circumferential direction of the pipe-shape structure; a sliding arm slidably disposed in a longitudinal direction of the fixing arm; a work tool disposed on an end of the sliding arm; and a link mechanism connected to the second rotation shaft to slide the sliding arm, thereby adjusting a distance between the inner circumferential surface of the pipe-shape structure and the work tool.

The link mechanism may include: a first link arm connected to the second rotation shaft; and a second link arm having one end pivotably connected to the first link arm and the other end pivotably connected to the sliding arm.

The work vehicle may further include a control part controlling the rotation driving part and the first driving part, and the link mechanism is folded or spread according to a relative rotation amount of the rotation driving part and the first driving part.

Embodiments of the inventive concept also provide a method of coating a pipe-shape structure includes a) rotating a work tool while a work vehicle comprising the work tool travels along a longitudinal direction in the pipe-shape structure to perform a coating process on an inner circumferential surface of the pipe-shape structure.

a) The rotating of the work tool to perform the coating process may include spraying paint onto the inner circumferential surface of the pipe-shape structure while the work vehicle travels from one end of the pipe-shape structure to the other end of the pipe-shape structure.

a) The rotating of the work tool to perform the coating process may include spraying grits onto the inner circumferential surface of the pipe-shape structure while the work vehicle travels from one end of the pipe-shape structure to the other end of the pipe-shape structure.

The spraying of the grits may further include collecting the used grits.

Advantageous Effects

According to the embodiments of the present invention, the coating process with respect to the inner circumferential surface of the pipe-shape structure may be automatically performed.

According to the embodiment of the present invention, the coating of the large-scale pipe-shape structure such as the tower of the wind power generator may be efficiently performed.

MODE FOR CARRYING OUT THE INVENTION

Hereinafter, a pipe-shape structure coating device according to an embodiment of the present invention will be described below in more detail with reference to the accompanying drawings. In description of the present invention, detailed descriptions related to well-known functions or configurations will be ruled out in order not to unnecessarily obscure subject matters of the present invention.

Figure 1:
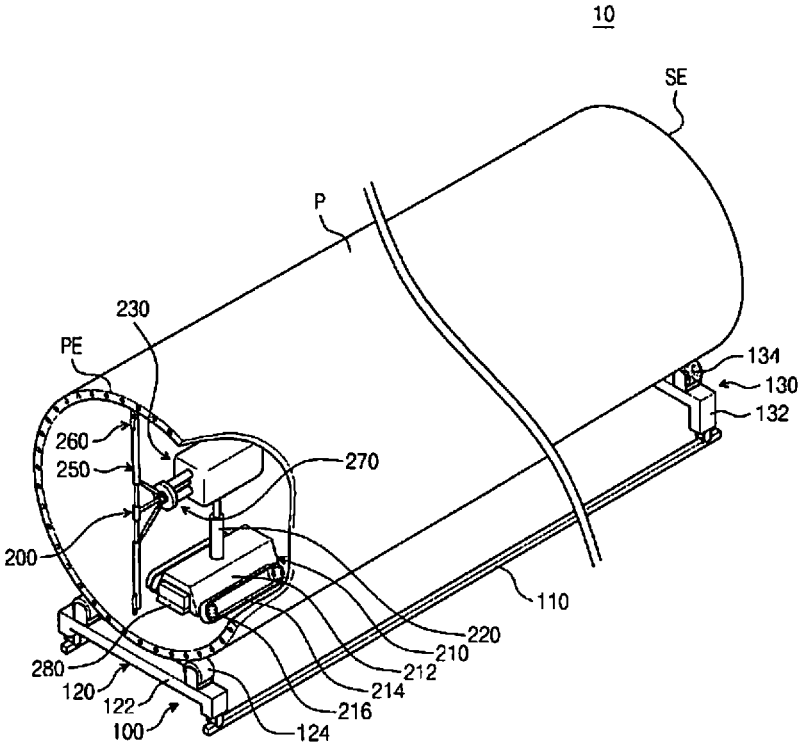
FIG. 1 is a perspective view of a pipe-shape structure coating device according to an embodiment of the present invention.
Figure 2:
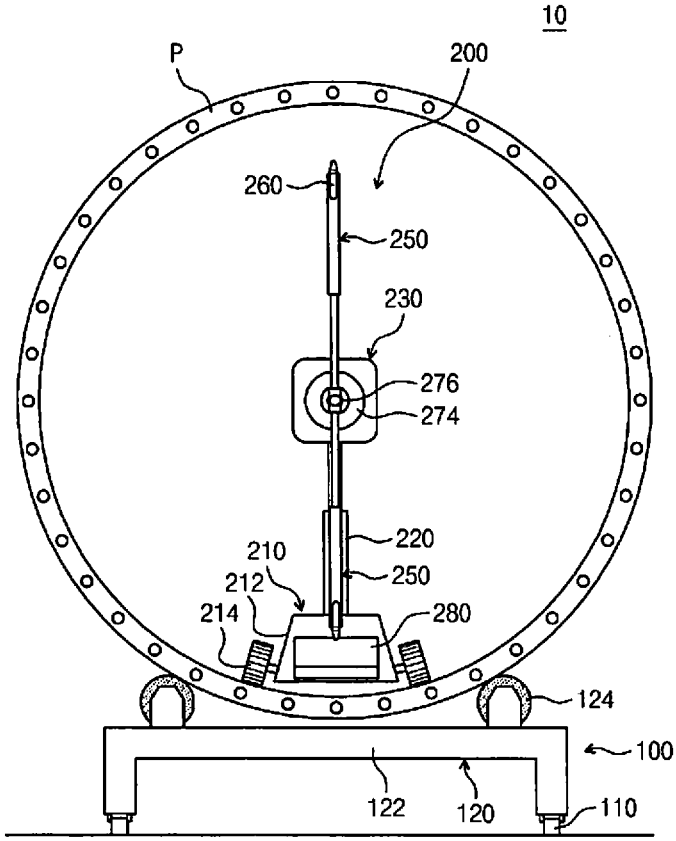
FIG. 2 is a front view of the pipe-shape structure coating device illustrated in FIG. 1.
Figure 3:
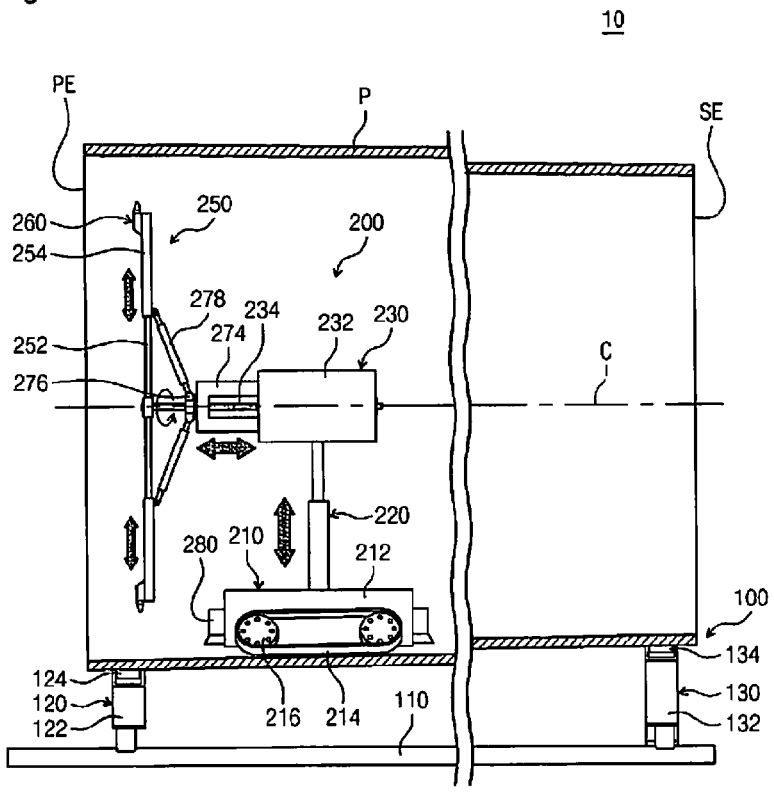
FIG. 3 is a side view of the pipe-shape structure coating device illustrated in FIG. 1.

FIG. 1 is a perspective view of a pipe-shape structure coating device according to an embodiment of the present invention. FIG. 2 is a front view of the pipe-shape structure coating device illustrated in FIG. 1. FIG. 3 is a side view of the pipe-shape structure coating device illustrated in FIG. 1.

Referring to FIGS. 1 to 3, a pipe-shape structure coating device 10 includes a rack unit 100 and a work vehicle 200.

A pipe-shape structure P having a conical shape is horizontally disposed on the rack unit 100. The pipe-shape structure P may be a tower of a wind power generator. The rack unit 100 includes a first guide rail 110, a first support 120, and a second support 130.

The first guide rail 110 is disposed along a longitudinal direction of the pipe-shape structure P. The first guide rail 110 has a length longer than that of the pipe-shape structure P. The first and second supports 120 and 130 are disposed on the first guide rail 110. The first and second supports 120 and 130 are disposed adjustable in position on the first guide rail 110 according to a length of the pipe-shape structure P so that the first and second supports 120 and 130 support both ends of the pipe-shape structure P. In the current embodiment, an end of both ends of the pipe-shape structure P having a relatively large diameter is referred to as one end PE, and the other end of both ends of the pipe-shape structure P having a relatively small diameter is referred to as the other end SE.

The first support 120 supports the one end PE of the pipe-shape structure P. The first support 120 includes a first movable block 122 and a pair of first support rollers 124. The first movable block 122 is slid along the first guide rail 110. The pair of first support rollers 124 are spaced apart from each other on the first movable block 122. The pair of first support rollers 124 support a lower end of the pipe-shape structure P.

The second support 130 supports the other end SE of the pipe-shape structure P at a position higher than the first support 120 so that the pipe-shape structure P is horizontally disposed. The second support 130 includes a second movable block 132 and a pair of second support rollers 134. The second movable block 132 is slid along the first guide rail 120. The pair of second support rollers 134 are spaced apart from each other on the second movable block 132. The pair of second support rollers 134 supports the other end SE of the pipe-shape structure P. For example, the second support 130 is adjustable in height according to a size of the pipe-shape structure P.

The work vehicle 200 is disposed inside the pipe-shape structure P disposed on the rack unit 100. The work vehicle 200 moves along a longitudinal direction of the pipe-shape structure P. The work vehicle 200 performs a coating process on an inner circumferential surface of the pipe-shape structure P. Here, the coating process may include the whole or one of a grit blasting process, a grit collection process, and a spray coating process.

The work vehicle 200 includes a movable vehicle 210, a column member 220, a body 230, a rotation arm 250, a work tool 260, and a distance adjustable member 270.

The movable vehicle 210 travels inside the pipe-shape structure P along its longitudinal direction. The movable vehicle 210 includes a movable body 212 and a traveling unit. The traveling unit is constituted by a pair of caterpillars 214 that allows the work vehicle 200 to stably move inside the pipe-shape structure P. The pair of caterpillars 214 are disposed on both side surfaces of the movable body 212. A wheel may be applied to the traveling unit of the movable vehicle 214 in addition to the caterpillar 214. Although the caterpillar 214 moves at a speed slower than that of the wheel, the caterpillar 214 is freely movable in even a curved inside of the pipe-shape structure P due to the caterpillar 214 has a wide contact area with the inner circumferential surface of the pipe-shape structure P. The caterpillar 214 of the movable vehicle 210 is inclined at a predetermined angle to increase a contact force with the inner circumferential surface of the pipe-shape structure P. Also, an electromagnet may be added on a driving wheel 216 of the caterpillar 214 to increase a contact force with the pipe-shape structure P when the movable vehicle 210 moves inside the pipe-shape structure P.

A suction nozzle 280 for collecting grits is disposed in front and rear sides of the movable vehicle 210.

The column member 220 is vertically disposed with respect to the movable body 212 of the movable vehicle 210. The column member 220 may have a variable length so that a rotation shaft 234 of the body 230 is located at a central axis C of the pipe-shape structure P. According to an example, the column member 220 may vary in length in a telescopic manner. That is, the rotation shaft 234 of the body 230 may be located at the central axis C of the pipe-shape structure P.

Figure 4:
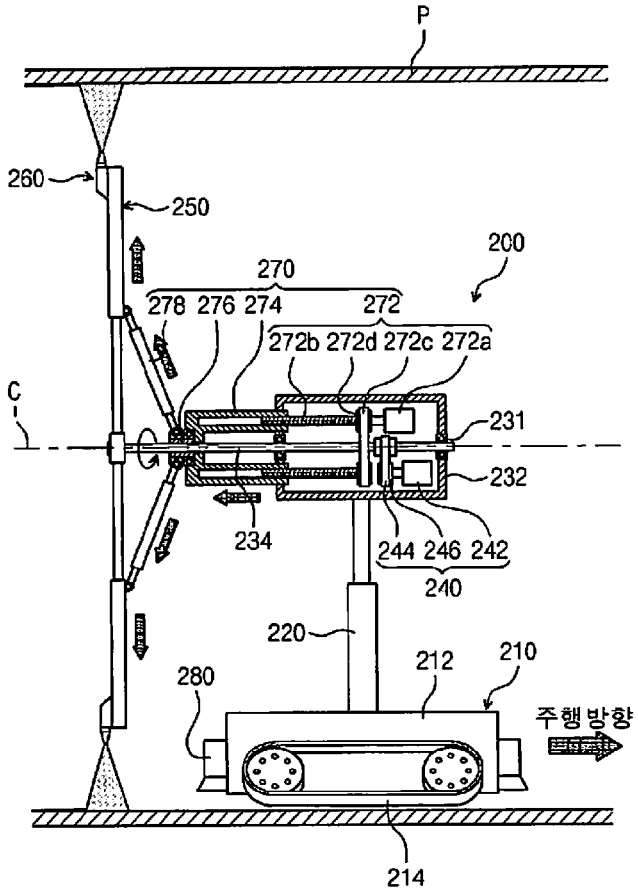
FIGS. 4 and 5 are views illustrating a state where a rotation arm varies in length by a distance adjustable member.

The body 230 is disposed on an upper end of the column member 220. The body 230 includes a case 232, the rotation shaft 234 parallel to the longitudinal direction of the pipe-shape structure P, and a rotation driving part (see reference numeral 240 of FIG. 4) for rotating the rotation shaft 234. As shown in FIG. 4, the rotation shaft 234 is rotatably disposed in the case 232 by bearings 231. The rotation shaft 234 has one end exposed from the case 232 and connected to the rotation arm 250. The rotation driving part 240 is disposed inside the case 232. The rotation driving part 240 includes a first motor 242 and a power transmission member constituted by a belt 244 for transferring a rotation force to the first motor 242 through the rotation shaft and a pulley.

Referring again to FIG. 3, the rotation arm 250 is connected to one end of the rotation shaft 234. The rotation arm 250 is rotated along a circumferential direction of the pipe-shape structure P by the rotation shaft 234. The rotation arm 250 may be provided in one or plurality, and two rotation arms 250 are illustrated as an example in the current embodiment. The rotation arm 250 includes a fixing arm 252 connected to the rotation shaft 234 and a sliding arm 254 extendably inserted into the fixing arm 252. The work tool 260 is disposed on an end of the sliding arm 254.

The rotation arm 250 may have a variable length so that the work tool 260 is spaced a predetermined distance from the inner circumferential surface of the pipe-shape structure P. According to an example, the rotation arm may vary in length in a telescopic manner.

The work tool 260 may be a coating nozzle or a blasting nozzle for spraying paint, for example, the coating nozzle will be described in the current embodiment. The work tool 260 is disposed on the rotation arm 250. Also, the work tool 260 is disposed on the rotation arm 250 so that the paint is sprayed toward the inner circumferential surface of the pipe-shape structure P.

The work tool 260 sprays the paint onto the inner circumferential surface of the pipe-shape structure P while moving from one end of the pipe-shape structure P to the other end of the pipe-shape structure P along the movable vehicle 210 in a state where the work tool 260 is mounted on the rotation arm 250. Here, the rotation driving part (see reference numeral 240 of FIG. 4) disposed in the body 230 rotates the rotation shaft 234 to rotate the rotation arm 250 connected to the ration shaft 234 together with the rotation shaft 234, thereby allowing the work tool 260 to be limitlessly rotated by driving of the rotation driving part 260.

Figure 5:
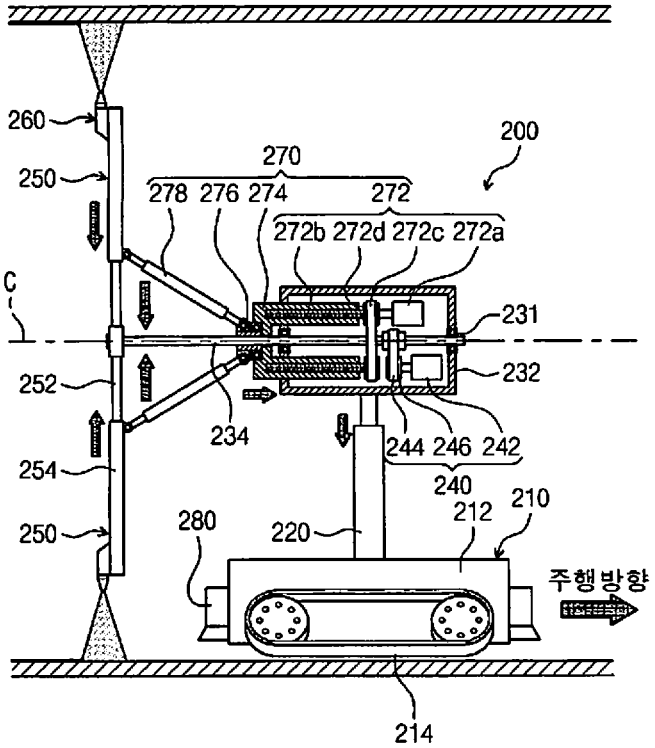

Since the pipe-shape structure P has the conical shape, the diameter of the one end PE of the pipe-shape structure P is different from that of the other end SE. Thus, to improve coating quality, the paint should be sprayed in a state where a distance between the coating nozzle and the inner circumferential surface of the pipe-shape structure P is constantly maintained. As shown in FIGS. 4 and 5, the work tool 260 may be maintained at a constant distance from the inner circumferential surface of the pipe-shape structure by adjusting a length of the rotation arm 250.

FIGS. 4 and 5 are views illustrating a state where a rotation arm varies in length by a distance adjustable member.

Referring to FIG. 4, the distance adjustable member 270 may allow the rotation arms 250 to simultaneously vary in length so that the work tool 260 disposed on the end of each of the rotation arms 250 is maintained at a constant distance from the inner circumferential surfaces of the pipe-shape structure P. The distance adjustable member 270 includes a first driving part 272, a slide block 274, a rotation ring 276, and link arms 278.

The first driving part 272 includes a motor **272*a* disposed in the case 232 of the body 230, two ball screws 272*b* connected to the slide block 274, and a belt 272*c* and pulley 272*d* transmitting a rotation force of the motor 272*a*** to the two ball screws.

The slide block 274 is disposed movable forward and backward on the case 232 in a longitudinal direction of the pipe-shape structure P. The slide block 264 moves forward and backward by the first driving part 272.

The rotation ring 276 is disposed movable forward and backward on the rotation shaft 234 and is rotated together with the rotation shaft 234. The rotation ring 276 is connected to the slide block 274 to move forward and backward on the rotation shaft 234 by the slide block 274.

The link arm 278 has one end that is hinge-coupled to the rotation ring 276 and the other end that is hinge-coupled to the sliding arm 254.

Hereinafter, an operation of the distance adjustable member 270 will be described.

Referring to FIG. 4, when the slide block 274 moves forward by the first driving part 272, the link arm is spread outward to allow the sliding arm 254 to be withdrawn from the fixing arm 252. Thus, the rotation arm 250 may extend in length.

Referring to FIG. 5, when the slide block 274 moves backward by the first driving part 272, the link arm 278 is folded inward to allow the sliding arm 254 of the rotation arm 250 to be inserted into the fixing arm 252. Thus, the rotation arm 250 may be shortened in length.

Through the adjustment in length of the rotation arm 250 by the distance adjustable member 270, the work tool 260 may be maintained at a constant distance from the inner circumferential surface (a surface to be applied) according to the inner diameter of the pipe-shape structure.

Figure 6:
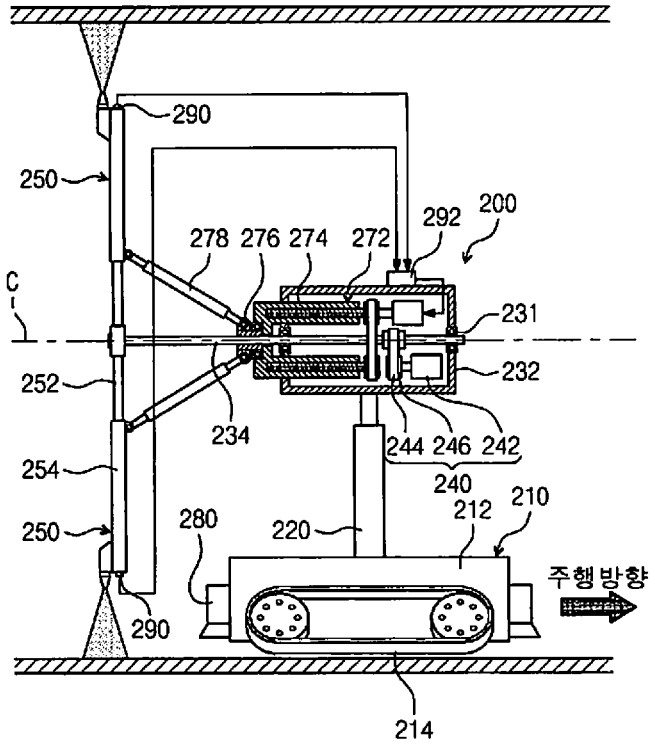
FIG. 6 is a view illustrating an example in which a distance measuring sensor is added in the rotation arm.

FIG. 6 is a view illustrating an example in which a distance measuring sensor is added in the rotation arm.

As shown in FIG. 6, a distance measuring sensor 290 may be mounted on the rotation arm 250. The distance measuring sensor 290 is disposed on an end of the rotation arm 250 to measure a distance with respect to the inner circumferential surface of the pipe-shape structure P. Data measured by the distance measuring sensor 290 is provided to a control part 292, and the control part 292 controls the first driving part 272 of the distance adjustable member 270. Thus, the distance measuring sensor 290 and the work vehicle 200 including the control part 292 may further accurately vary lengths of the rotation arms 250 so that a distance between the work tool 260 and the inner circumferential surface of the pipe-shape structure P is maintained at a constant distance.

Hereinafter, a pipe-shape structure coating process of the pipe-shape structure coating device 10 will be described with reference to the FIGS. 1 to 6.

In a state where the pipe-shape structure P is horizontally disposed on the rack unit 100, the work vehicle 200 performs a coating process on the inner circumferential surface of the pipe-shape structure P while moving along the longitudinal direction of the pipe-shape structure in the pipe-shape structure P.

The coating process may include a grit blasting process, a grit collecting process, and a spray coating process.

The grit blasting process is performed in a state where the blasting nozzle is mounted on the rotation arm 250. The work vehicle 200 performs a blasting process for treating a surface of the pipe-shape structure while traveling from the one end PE of the pipe-shape structure P to the other end SE of the pipe-shape structure P. Since the work vehicle 200 travels while rotating the two rotation arms 250 at about 360 degrees, two work lines each of which has a helical shape are formed on the inner circumferential surface of the pipe-shape structure P.

In the grit collecting process, the work vehicle 200 collects grits used in the grit blasting process while reversely traveling from the other end SE of the pipe-shape structure to the one end PE of the pipe-shape structure. The grits lying on a bottom of the inner circumferential surface of the pipe-shape structure are collected by the suction nozzles 280 respectively disposed on front and back sides of the movable vehicle 210.

The spray coating process is performed in a state where the blasting nozzle mounted on the rotation arm 250 is replaced to a coating nozzle. The work vehicle 200 rotates the rotation arms 250 mounted on the work vehicle 200 to spray paint onto the inner circumferential surface of the pipe-shape structure P while traveling from the one end PE of the pipe-shape structure to the other end SE of the pipe-shape structure. Since the work vehicle 200 travels while rotating the two rotation arms 250 at about 360 degrees, the two work lines each of which has the helical shape are formed on the inner circumferential surface of the pipe-shape structure 250.

Although not shown, in the pipe-shape structure coating device 10, a grit supply line and a paint supply line are connected to the work vehicle 200. The grits and paint supplied through the grit supply line and the paint supply line are supplied to the work tool 260 through passages defined in the rotation shaft 234 of the body 230 and the rotation arm 250, respectively.

In the pipe-shape structure coating device 10, the blasting nozzle and the coating nozzle may be mounted on the rotation arm 250 so that it is unnecessary to replace the blasting and coating nozzles in the grit blasting and spray coating processes, and the coating process is successively performed.

Figure 7:
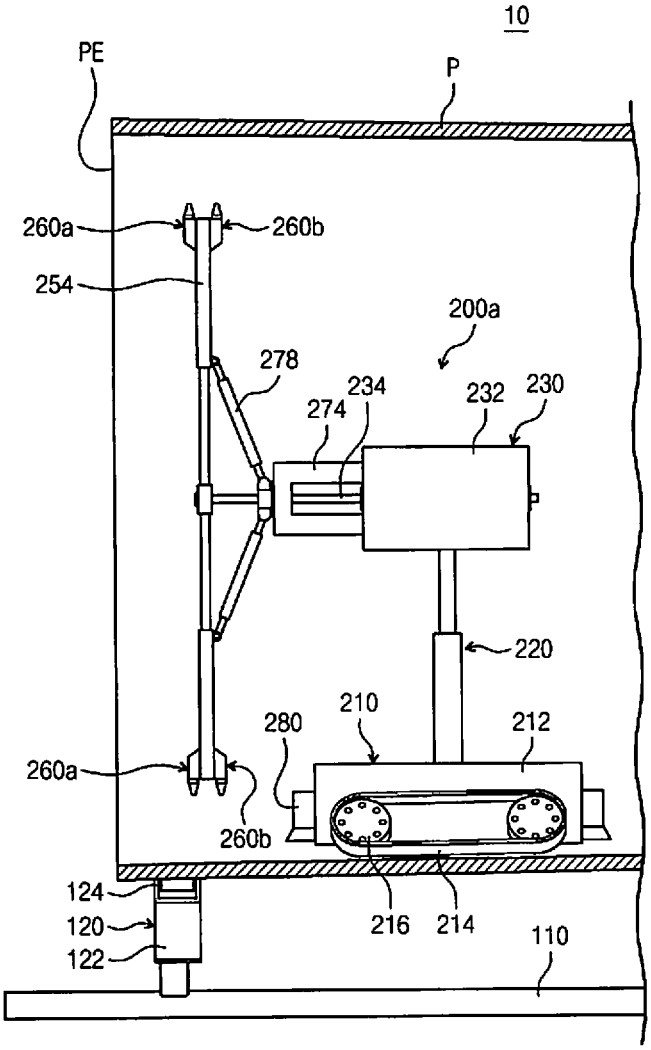
FIG. 7 is a view illustrating an example in which a coating nozzle and blasting nozzle for spraying paint are mounted on the rotation arm.

FIG. 7 is a view illustrating an example in which a coating nozzle and blasting nozzle for spraying paint are mounted on the rotation arm.

Referring to FIG. 7, a coating nozzle 260*a* and a blasting nozzle 260*b* are disposed on the rotation arm. A work vehicle 200*a* including the coating nozzle 260*a* and the blasting nozzle 260*b* may allow the coating nozzle 260*a* and the blasting nozzle 260*b* to successively perform a coating process without replacing the work tool in the grit blasting process and the spray coating process.

Figure 8:
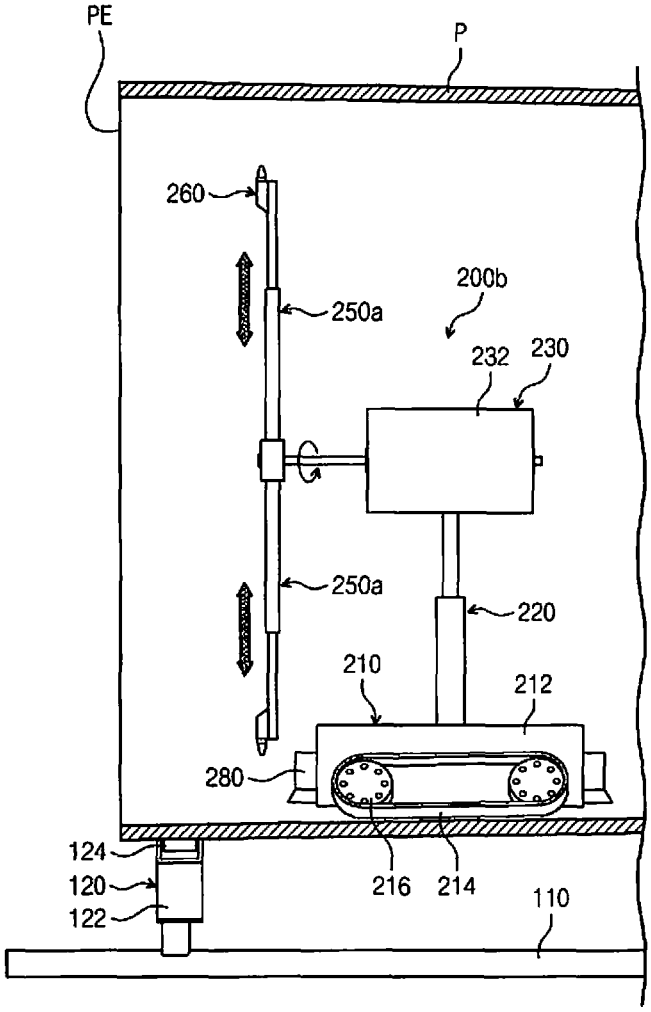
FIG. 8 is a view illustrating a work vehicle including a rotation arm having a length that is variable in a telescopic manner.

FIG. 8 is a view illustrating a work vehicle including a rotation arm having a length that is variable in a telescopic manner.

Referring to FIG. 8, a work vehicle 200*b* includes a rotation arm 250*a* having a variable length in a telescopic manner. Thus, the distance adjustable member 270 illustrated in FIG. 1 may be omitted in the work vehicle 200*b*.

Figure 9:
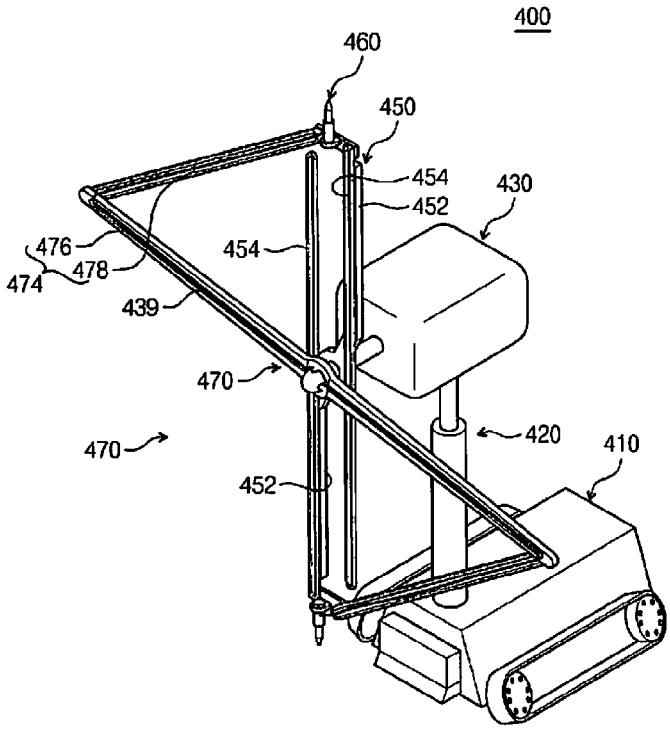
FIG. 9 is a perspective view of a work vehicle according to another embodiment of the present invention.
Figure 10:
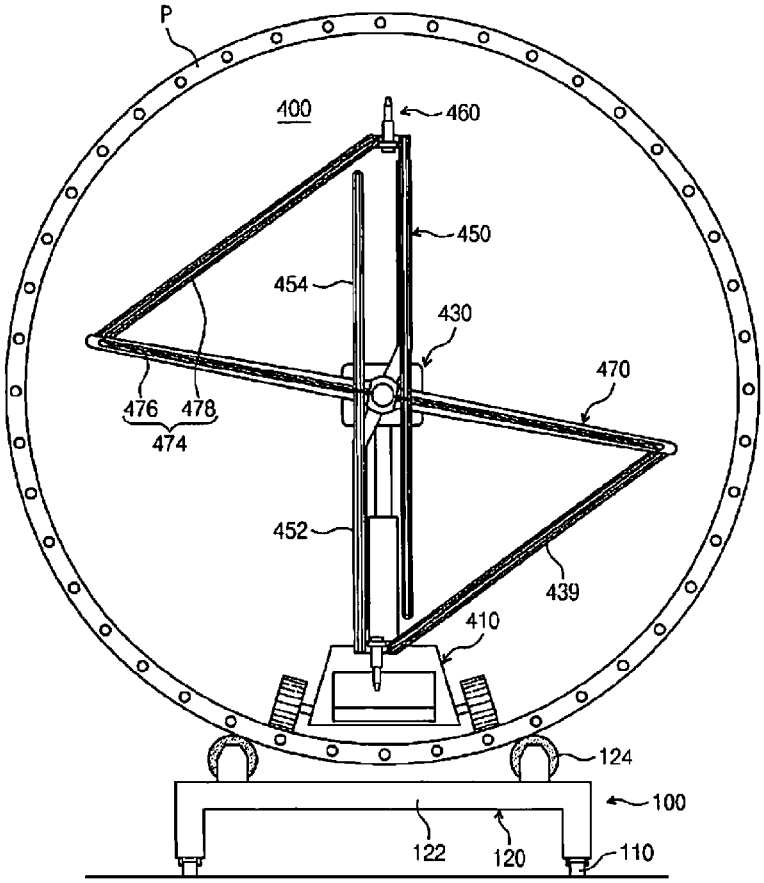
FIG. 10 is a front view of the work vehicle according to another embodiment of the present invention.
Figure 11:
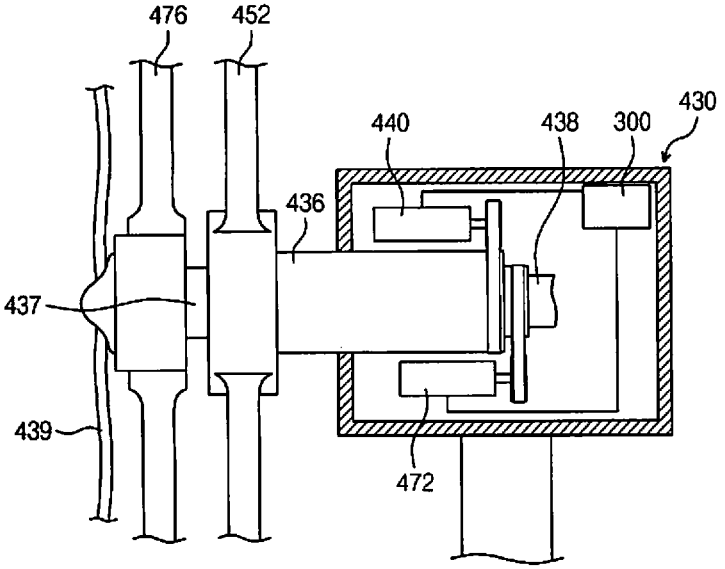
FIG. 11 is a cross-sectional view of constitutions of a body.

FIGS. 9 and 10 are a perspective view and front view of a work vehicle according to another embodiment of the present invention, and FIG. 11 is a cross-sectional view of constitutions of a body.

Referring to FIGS. 9 and 10, a work vehicle 400 includes a movable vehicle 410, a column member 420, a body 430, a rotation arm 450, a work tool 460, and a distance adjustable member 470.

The movable vehicle 410, the column member 420, the body 430, the rotation arm 450, the work tool 460, and the distance adjustable member 470 may be substantially similar to the movable vehicle 210, the column member 220, the body 230, the rotation arm 250, the work tool 260, and the distance adjustable member 270 of the work vehicle 200 in FIG. 1, respectively.

Hereinafter, features of the current embodiment will be described.

As shown in FIG. 11, a first rotation shaft 436 and a second rotation shaft 437 are coaxially provided in parallel to a longitudinal direction of a pipe-shape structure P in the body 430. The first rotation shaft 436 surrounds the second rotation shaft 437. A supply tube 438 for supplying paint and air is disposed in the second rotation shaft 437. The paint and air may be supplied to the work tool 460 through the supply tube 438 and a supply hose connected to an end of the supply tube 438. The supply hose 439 may be fixed to a link mechanism 474.

Also, a rotation driving part 440 for rotating the first rotation shaft 436 and a first driving part 472 for rotating the second rotation shaft 437 are disposed in the body 430. The rotation driving part 440 and the first driving part 472 are controlled by a control part 300. The control part 300 operates the link mechanism 474 through the control of a relative rotation amount of the rotation driving part 440 and the first driving part 472.

The rotation arm 450 includes a fixing arm 452 connected to the first rotation shaft 436 and a sliding arm 454 slidably disposed on the fixing arm 452. The fixing arm 452 is disposed at a position parallelly spaced apart from an arbitrary line passing through a rotation center axis to prevent the fixing arm 452 from interfering with the sliding arm 454 adjacent thereto while the sliding arm 454 is slid.

The distance adjustable member 470 includes the first driving part 472 and the link mechanism 474 operated in a slider-crank mechanism manner.

The link mechanism 474 is connected to the second rotation shaft 437 to slide the sliding arm so as to adjust a distance between the work tool 460 and the inner circumferential surface of the pipe-shape structure P. The link mechanism 474 includes a first link arm 476 and a second link arm 478. The first link arm 476 is connected to the second rotation shaft 437. The second link arm 478 has one end pivotably connected to the first link arm 476 and the other end pivotably connected to the sliding arm 454.

As for an explanation of an operation of the distance adjustable member 470, the rotation arm 450 and the link mechanism 474 are rotated at the same speed by the rotation driving part 440 and the first driving part 472 in a state where it is unnecessary to adjust a distance with respect to the work tool 460. In a state where the adjustment in distance with respect to the work tool 460 is necessary, when the control part controls a rotation speed of any one of the rotation driving part 440 and the first driving part 472 to a low or high speed, the link mechanism 474 is spread or folded by a change in relative rotation amount of the rotation arm 450 and the link mechanism 474. The sliding arm is slid on the fixing arm 452 by the spreading or folding of the link mechanism 474, and thus the distance between the work tool 460 and the inner circumferential surface of the pipe-shape structure is adjusted.

In the foregoing embodiments, the tower of the wind power generator is exemplified as the pipe-shape structure, but the present invention is not limited thereto.

Also, in the foregoing embodiments, the pipe-shape structure is exemplified as the conical shape pipe-shape structure, but on the other hand, the pipe-shape structure may have a cylindrical shape having a same diameter in a longitudinal direction thereof. In this case, the rotation arm may have a structure having a non-variable length.

If a person of ordinary skill in the art to which this invention pertains without departing from the essential characteristics of the present invention in the range described above, is only the spirit of the present invention have been described for illustrative purposes, various modifications, additions and substitutions are possible. Therefore, to explain the embodiments disclosed in the present disclosure is not limited to the technical idea of the present disclosure, and are not limited by this embodiment without departing from the scope or spirit of the invention. The scope of protection of the present disclosure, all the technical idea, within the scope of its equivalent shall be construed by the following claims should be construed as being included in the scope of the present disclosure.

The invention claimed is:

1. A pipe coating device comprising:

a work vehicle performing a coating process with respect to an inner circumferential surface of a pipe while traveling along a longitudinal direction in the pipe, wherein the work vehicle comprises:

a movable vehicle traveling along the longitudinal direction in the pipe;

a column member vertically disposed on the movable vehicle;

a body disposed on the column member, the body comprising a rotation shaft in parallel with the longitudinal direction of the pipe;

at least one rotation arm connected to the rotation shaft and rotating along a circumferential direction of the pipe;

a work tool disposed on the at least one rotation arm; and a distance adjustable member varying a length of the rotation arm, wherein the at least one rotation arm comprises:

a fixing arm connected to the rotation shaft; and a sliding arm extendably inserted into the fixing arm and on which the work tool is disposed, wherein the distance adjustable member slides the sliding arm with respect to the fixing arm, and wherein the distance adjustable member comprises:

a first driving part disposed in the body;

a slide block slidably disposed on the rotation shaft, the slide block being slid in a longitudinal direction of the rotation shaft by the first driving part;

a rotation ring slid together with the slide block, the rotation ring being rotated together with the rotation shaft; and a link arm having one end hinge-coupled to the rotation ring and the other end hinge-coupled to the sliding arm.

2. The pipe-shape structure coating device of claim 1, further comprising a suction nozzle disposed on the movable vehicle to collect grits lying on a bottom of the inner circumferential surface of the pipe.

3. The pipe coating device of claim 1, wherein the work tool comprises at least one of a coating nozzle and a blasting nozzle.

4. The pipe coating device of claim 1, further comprising a rack unit on which the pipe is disposed.

5. A pipe coating device comprising:

a work vehicle performing a coating process with respect to an inner circumferential surface of a pipe while traveling along a longitudinal direction in the pipe, wherein the work vehicle comprises:

a body comprising first and second rotation shafts coaxially disposed in parallel with the longitudinal direction of the pipe, a rotation driving part driving the first rotation shaft, and a first driving part driving the second rotation shaft;

a fixing arm connected to the first rotation shaft, the fixing arm being limitlessly rotated along a circumferential direction of the pipe;

a sliding arm slidably disposed in a longitudinal direction of the fixing arm;

a work tool disposed on an end of the sliding arm; and a link mechanism connected to the second rotation shaft to slide the sliding arm, thereby adjusting a distance between the inner circumferential surface of the pipe and the work tool.

6. The pipe coating device of claim 5, wherein the link mechanism comprises:

a first link arm connected to the second rotation shaft; and a second link arm having one end pivotably connected to the first link arm and the other end pivotably connected to the sliding arm.

7. The pipe coating device of claim 5, wherein the work vehicle further comprises a control part controlling the rotation driving part and the first driving part, and the link mechanism is folded or spread according to a relative rotation amount of the rotation driving part and the first driving part.

* * * * *